United States Patent [19]

Baranyi et al.

[11] Patent Number: 4,952,471

[45] Date of Patent: Aug. 28, 1990

[54] QUINACRIDONE PHOTOCONDUCTOR IMAGING MEMBERS

[75] Inventors: Giuseppa Baranyi; Ah-Mee Hor, both of Mississauga; Rafik O. Loutfy, Willowdale, all of Canada

[73] Assignee: Xerox Corporation, Stamford, Conn.

[21] Appl. No.: 214,353

[22] Filed: Jul. 1, 1988

[51] Int. Cl.[5] ..... G03G 5/082

[52] U.S. Cl. ..... 430/59; 430/128; 430/135

[58] Field of Search ..... 430/58, 59, 69, 75, 430/76, 128, 135

[56] References Cited

U.S. PATENT DOCUMENTS

| | | | |
|---|---|---|---|
| 3,667,943 | 6/1972 | Weinberger | 96/1 PC |
| 3,667,944 | 6/1972 | Weinberger | 96/1 PC |
| 3,667,945 | 6/1972 | Tulagin | 96/1 PC |
| 3,888,665 | 6/1975 | Wiedemann | 96/1.5 |
| 3,972,717 | 8/1976 | Wiedemann | 96/1.5 |
| 3,992,205 | 11/1976 | Wiedmann | 96/1.6 |
| 4,431,722 | 2/1984 | Takei et al. | 430/57 |
| 4,582,772 | 4/1986 | Teuscher et al. | 430/58 |

FOREIGN PATENT DOCUMENTS 61-149963 7/1986 Japan .

61-151543 7/1986 Japan .

*Primary Examiner*—John L. Goodrow

*Attorney, Agent, or Firm*—E. O. Palazzo

[57] ABSTRACT

Disclosed is an improved layered photoresponsive imaging member comprised of a vacuum evaporated photogenerator layer comprised of fractionally sublimed quinacridone pigments including 2,9-dichloroquinacridone, and an aryl amine hole transport layer comprised of molecules of the following formula dispersed in a resinous binder, and wherein X is selected from the group consisting of halogen and alkyl.

29 Claims, 3 Drawing Sheets

QUINACRIDONE PHOTOCONDUCTOR IMAGING MEMBERS

BACKGROUND OF THE INVENTION

This invention is generally directed to layered photoresponsive imaging members, and more specifically to photoconductive members having incorporated therein certain quinacridone compounds. In one embodiment of the present invention there are provided organic photoconductive layered imaging members comprised of certain quinacridone compounds and aryl amine hole transport layers. Further, in one important embodiment of the present invention, there is provided a photoresponsive imaging member, or device comprised of fractionally sublimed quinacridones comprised of 2,9-dichloroquinacridone (Hostaperm Red EG trans 5250), and an aryl amine hole transport layer. The aforementioned photoconductive members possess a number of advantages indicated hereinafter, inclusive of high photosensitivity, low residual potentials, low dark decay characteristics, and stable cycling properties. Accordingly, the photoresponsive imaging members of the present invention can be selected for various electrophotographic imaging and printing processes wherein, for example, latent images are formed thereon followed by development, and transfer to a suitable substrate.

Illustrated in U.S. Pat. No. 3,888,665 are organic double layered electrophotographic recording materials consisting of an electroconductive support with a photoconductive double layer of organic materials which consists of a homogeneous, opaque, charge carrier producing dyestuff layer of various quinacridone compounds, reference the formula illustrated in the Abstract of the Disclosure, and a transparent top layer of insulating materials containing at least one charge transporting compound. As indicated in column 4 of this patent, the compounds of formulas 2 and 8, 3,10-dichloroquinacridone and 2,9-dibromoquinacridone, respectively, can be selected. Moreover, it is stated in column 4, beginning at around line 60, that the organic dyestuff layer may be applied by vapor depositing the dyestuff in a vacuum. Additionally, this patent discloses a number of resinous binders for the charge transport layer including polycarbonate resins, reference column 7. Without fractional sublimation as is accomplished with the process of the present invention, the photogenerating layer will contain impurities therein causing the resulting imaging members to possess disadvantages such as lower photosenstivity, and the like, as recited in U.S. Ser. No. 214,248, entitled Ingidoid Photoconductor Imaging Members, and with the listed inventors, Giuseppa Baranyi, Ah-Mee Hor and Rafik O. Loutfy, the disclosure of which is totally incorporated herein by reference.

Also, there are illustrated in U.S. Pat. No. 3,992,205 electrophotographic recording materials with a plurality of dyes, reference the Abstract of the Disclosure, columns 2 and 6. In column 6, it is indicated that quinacridones of formula 2 can be selected.

Prior art of background interest includes U.S. Pat. Nos. 3,667,943; 3,667,944; 3,667,945; and 3,972,717.

Furthermore, Toshiba has recently disclosed the use of similar quinacridone compositions as charge generator layers in conjunction with various hydrazone transport layers, reference Japanese Kokai Tokkyo Koho JP 61/151543 A2 [86/151543], 10 July 1986, and Japanese Kokai Tokkyo Koho JP 61/149963 A2 [86/149963], 8 July 1986.

Additionally, numerous different xerographic photoconductive members are known including, for example, a homogeneous layer of a single material such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photoconductive inorganic compound dispersed in an electrically insulating organic resin binder. These members contain, for example coated on a paper backing, a binder layer containing particles of zinc oxide uniformly dispersed therein. The binder materials disclosed in this patent comprise a material such as polycarbonate resins, polyester resins, polyamide resins, and the like, which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain quality images.

Also, there have been disclosed other layered photoresponsive devices including those comprised of separate generating layers, and transport layers as described in U.S. Pat. No. 4,265,990, the disclosure of which is totally incorporated herein by reference. Examples of photogenerating layers disclosed in this patent include trigonal selenium and phthalocyanines, while examples of transport layers include certain diamines as mentioned herein.

Many other patents are in existence describing photoresponsive devices including layered devices containing generating substances, such as U.S. Pat. No. 3,041,167, which discloses an overcoated imaging member containing a conductive substrate, a photoconductive layer, and an overcoating layer of an electrically insulating polymeric material. This member is utilized in an electrophotographic copying system by, for example, initially charging the member with an electrostatic charge of a first polarity, and imagewise exposing to form an electrostatic latent image, which can be subsequently developed to form a visible image.

Furthermore, there are disclosed in U.S. Pat. Nos. 4,232,102 and 4,233,383 photoresponsive imaging members comprised of trigonal selenium doped with sodium carbonate, sodium selenite, and trigonal selenium doped with barium carbonate, and barium selenite, or mixtures thereof. Moreover, there are disclosed in U.S. Pat. No. 3,824,099 certain photosensitive hydroxy squaraine compositions. According to the disclosure of this patent, the squaraine compositions are photosensitive in normal electrostatographic imaging systems.

Also known are photoconductive devices containing therein various squaraine compositions. Thus, for example, there are illustrated in U.S. Pat. No. 4,508,803, the disclosure of which is totally incorporated herein by reference, photoconductive devices containing novel benzyl fluorinated squaraine compositions. Specifically, in one embodiment illustrated in the '803 patent there is described an improved photoresponsive device comprised of a supporting substrate, a hole blocking layer, an optional adhesive interface layer, an inorganic photogenerating layer, a photoconducting composition layer comprised of benzyl fluorinated squaraine compositions, and a hole transport layer. Other representative patents disclosing photoconductive devices with squaraine components therein, or processes for the preparation of squaraines include U.S. Pat. Nos. 4,507,408; 4,552,822; 4,559,286; 4,507,480; 4,524,220; 4,524,219; 4,524,218; 4,525,592; 4,559,286; 4,415,639; 4,471,041; and 4,486,520. The disclosures of each of the aforementioned patents are totally incorporated herein by reference.

Moreover, disclosed in the published literature are composite electrophotographic photosensitive materials with various azo compounds. For example, there are illustrated in Japanese Ricoh Patent Publication No. 6064354, published April 12, 1985, composite photoconductors wherein one of the photoconductor layers contain an azo compound of the formulas as illustrated. Further, there are illustrated in several U.S. patents layered organic electrophotographic photoconductor elements with azo, bisazo, or related compounds. Examples of these patents include 4,400,455; 4,551,404; 4,390,608; 4,327,168; 4,299,896; 4,314,015; 4,486,522; 4,486,519; 4,551,404; and Konishiroku Japanese Patent Laid Open Publication No. 60111247.

Although many photoconductive imaging members are known, there remains a need for members with other photogenerator layers. Additionally, there continues to be a need for layered photoresponsive imaging members having incorporated therein certain quinacridone compounds, which members will enable the generation of acceptable high quality images and wherein these members can be repeatedly used in a number of imaging cycles without deterioration thereof from the machine environment or surrounding conditions. Moreover, there is a need for improved layered photoresponsive imaging members wherein the quinacridone compounds selected for one of the layers in combination with specific aryl amine charge transport compositions are substantially inert to the users of such members. Additionally, there is an important need for layered photoconductors with fractionally sublimed quinacridone compounds, which photoconductors are of high sensitivity, have low dark decay values, low residual potentials, and possess high cyclic stability. Furthermore, there continues to be a need for photoresponsive imaging members which can be positively or negatively charged thus permitting the development of images, including color images, with positively or negatively charged toner compositions. Additionally, there continues to be an important need for disposable imaging members with nontoxic organic pigments. Also, there is a need for disposable imaging members useful in xerographic imaging processes, and xerographic printing systems wherein, for example, light emitting diodes (LED), helium cadmium or helium-neon lasers can be selected; and wherein these members are particularly sensitive to the visible region of the spectrum, that is from about 400 to about 700 nanometers. Also, there is a need for low cost, high quality imaging members wherein reduced amounts of photosensitive materials can be selected.

SUMMARY OF THE INVENTION

It is therefore an object of the present invention to provide photoresponsive imaging members containing therein certain quinacridone compounds.

A further object of the present invention is the provision of improved photoconductive imaging members with high photosensitivity, low residual potentials, low dark decay values, and acceptable cyclic stability.

Additionally, in a further object of the present invention there are provided disposable photoconductive imaging members.

Another object of the present invention resides in the provision of organic layered photoconductive imaging members containing therein certain vacuum evaporated fractionally sublimed quinacridone compounds as photogenerating layers and aryl amine hole transport layers.

In yet another specific object of the present invention there are provided negatively charged layered photoresponsive imaging members comprised of certain vacuum evaporated fractionally sublimed quinacridone pigment compositions optionally dispersed in a resinous binder, and a hole transport layer comprised of aryl amine molecules.

There are provided in another object of the present invention positively charged layered photoresponsive imaging members with a top vacuum evaporated fractionally sublimed quinacridone pigment composition optionally dispersed in a resinous binder, and thereunder a hole transport layer comprised of aryl amine molecules.

Further, in yet another object of the present invention there are provided imaging and printing methods with the improved photoresponsive imaging members illustrated herein.

Also, in a further important object of the present invention there are provided improved imaging members sensitive to light in the visible region of the spectrum, that is, from about 400 to about 700 nanometers.

These and other objects of the present invention are accomplished by the provision of layered photoconductive imaging members containing therein certain quinacridone compounds. More specifically, the layered photoconductive imaging members of the present invention are comprised of specific vacuum evaporated fractionally sublimed quinacridone compounds, which function as a photogenerating source, and in contact therewith an aryl hole transport layer.

Accordingly, the photoconductive layered imaging members of the present invention are comprised of, for example, a supporting substrate, an aryl diamine hole transport layer, and a quinacridone of the formula of FIG. 1, wherein X is halogen, such as chlorine, bromine, fluorine, or iodine; alkyl, alkoxy, hydrogen, or hydroxy. Examples of alkyl and alkoxy substituents include those with from 1 to about 20 carbon atoms such as methyl, methoxy, ethyl, ethoxy, propyl, propoxy, butyl, butoxy, and the like. Of the aforementioned quinacridones there is preferred for the imaging members of the present invention 2,9-dichloroquinacridone available from BASF as Hostaperm Red EG 5250 (Pigment Red 209).

Illustrative examples of other fractionally sublimed quinacridone compounds that can be selected for the imaging members of the present invention, and with extended spectral response in the red region of the spectrum include those represented by the formula of FIG. 2, wherein X is as defined herein.

With further respect to the photoconductive imaging members of the present invention, the photogenerating quinacridone compounds can be situated between the supporting substrate and the aryl amine hole transport layer; or alternatively, the aryl amine hole transport layer may be situated between the supporting substrate and the layer comprised of the photogenerating quinacridone compounds illustrated herein.

In another specific illustrative embodiment, the improved photoconductive imaging member of the present invention is comprised of (1) a supporting substrate; (2) a hole blocking layer; (3) an optional adhesive interface layer; (4) a photogenerating layer comprised of the quinacridone compounds of the formulas of FIGS. 1 or 2, and (5) an aryl amine hole transport layer. Therefore, the photoconductive imaging member of the present invention in one important embodiment is comprised of a conductive supporting substrate, a hole blocking silane or metal oxide layer in contact therewith, a adhesive layer, a photogenerating layer comprised of quinacridone compounds representated by the formulas of FIGS. 1 or 2 overcoated with an adhesive layer, and as a top layer a hole transport layer comprised of aryl amines dispersed in a resinous binder.

Various known processes can be selected for the preparation of the photoconductive imaging members of the present invention, the process parameters in the order of coating of the layers being dependent on the member desired. Specifically, for example, in one method the quinacridone fractionally sublimed photogenerating layer is deposited on a supporting substrate by vacuum sublimation, and subsequently the hole transport layer is deposited thereover by solution coating. In another process variant, the layered photoconductive device can be prepared by providing the conductive substrate containing the hole blocking layer and an optional adhesive layer, and applying thereto by solvent coating processes, laminating processes, or other methods, the quinacridone photogenerating layer, and the aryl amine hole transport layer.

The quinacridone compounds represented by the formulas of FIGS. 1 or 2 are purified prior to incorporation in the imaging members by fractional sublimation, which involves subjecting these pigment compounds to a temperature of from about 200° to 500° C., whereby impurities and decomposition products more volatile than the desired components are separated at a temperature zone of below 300° C. There are thus obtained the desired purified quinacridone components at a purity of at least about 95 percent at a temperature zone of from about 400° to 440° C. separated from the nonvolatile impurities, which remain at the high temperature (500° C.) zone.

The improved photoconductive imaging members of the present invention can be incorporated into numerous imaging processes and apparatuses inclusive of those well known such as xerographic imaging and printing processes. Specifically, the imaging members of the present invention are useful in xerographic imaging processes wherein the quinacridone pigments absorb light of a wavelength of from about 400 nanometers to about 600 nanometers. In these processes, electrostatic latent images usually are initially formed on the imaging member followed by development and thereafter transferring the image to a suitable substrate.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Preferred embodiments will now be illustrated with reference to specific photoconductive imaging members containing the quinacridone compounds illustrated herein.

Figure 1:
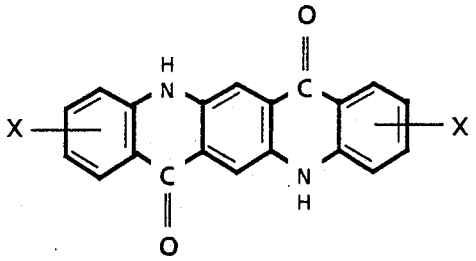
FIGS. 1 and 2 represent the photogenerating fractionally sublimed quinacridones of the present invention.
Figure 2:
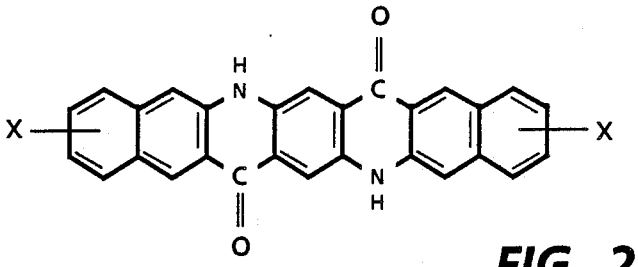
Figure 3:
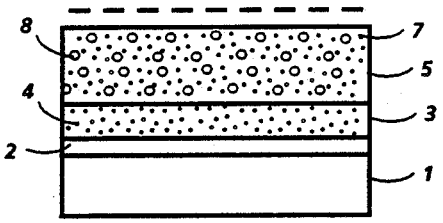
FIG. 3 is a partially schematic cross-sectional view of a negatively charged photoresponsive imaging member of the present invention.

Illustrated in FIG. 3 is a negatively charged photoresponsive imaging member of the present invention comprised of a substrate 1, an optional adhesive layer 2, a vacuum evaporated photogenerator layer 3 comprised of a fractionally sublimed quinacridone pigment selected from the group consisting of those represented by the formulas of FIGS. 1 or 2, and preferably 2,9-dichloro-quinacridone available from BASF as Hostaperm Red EG trans 5250 (Pigment Red 209) optionally dispersed in a resinous binder composition 4, and a charge carrier hole transport layer 5 comprised of an aryl amine, such as N,N'-diphenyl-N,N'-bis(3-methylphenyl)-[1,1'-biphenyl]-4,4'-diamine 7 dispersed in a polycarbonate resinous binder 8.

Figure 4:
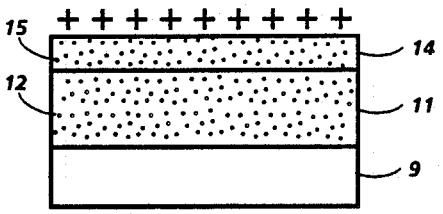
FIG. 4 is a partially schematic cross-sectional view of a positively charged photoresponsive imaging member of the present invention.

Illustrated in FIG. 4 is essentially the same member as shown in FIG. 1 with the exception that the hole transport layer is situated between the supporting substrate and the photogenerating layer. More specifically, with reference to this Figure, there is illustrated a positively charged photoconductive imaging member comprised of a supporting substrate 9, a hole transport layer 11 comprised of the aryl amine hole transport composition dispersed in an inactive resinous binder composition 12, and a photogenerating layer 14 comprised of a quinacridone compound selected from the group consisting of those compounds represented by the formulas of FIGS. 1 or 2, and preferably where X is halogen, optionally dispersed in a resinous binder composition 15.

Figure 5:
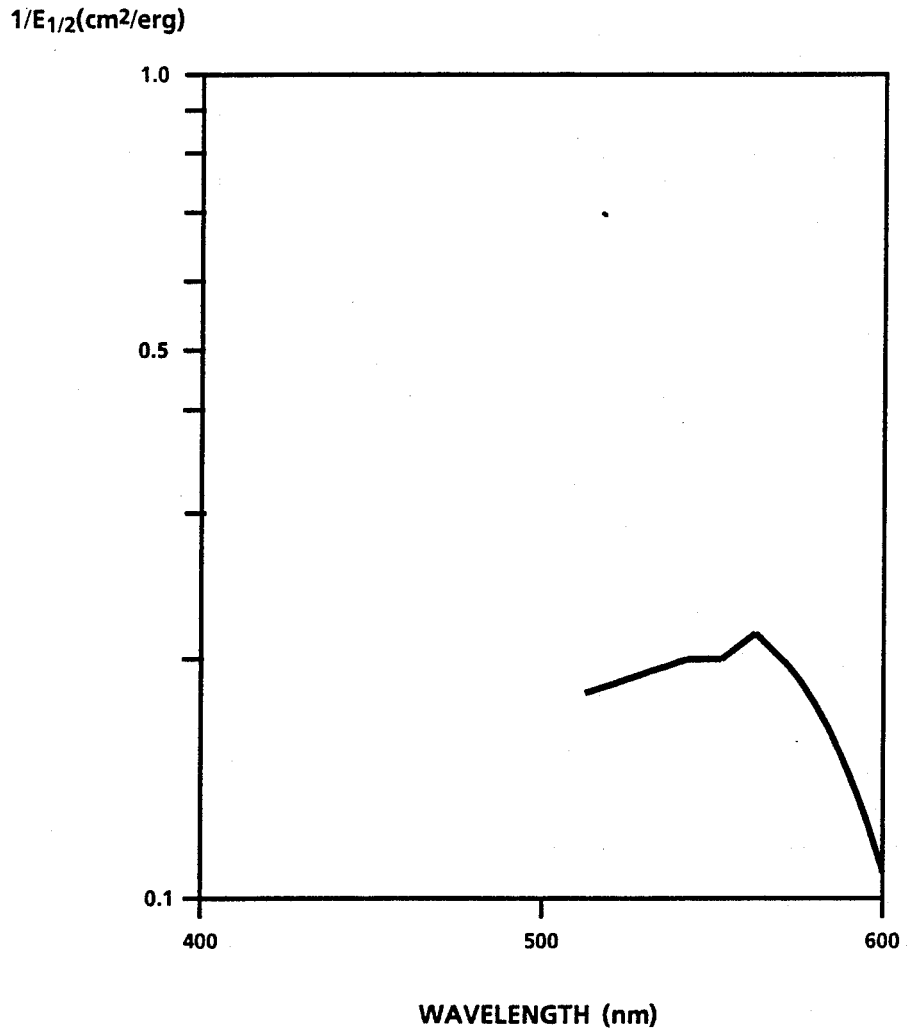
FIG. 5 is a line graph illustrating the spectral response of specific quinacridone pigment of the present invention.

Illustrated in FIG. 5 is a plot of the $1/E_{\frac{1}{2}}$ value versus wavelength in nanometers for photoresponsive imaging members prepared in accordance with Example II. Specifically, this curve represents the spectral response of the imaging member of Example II.

Figure 6:
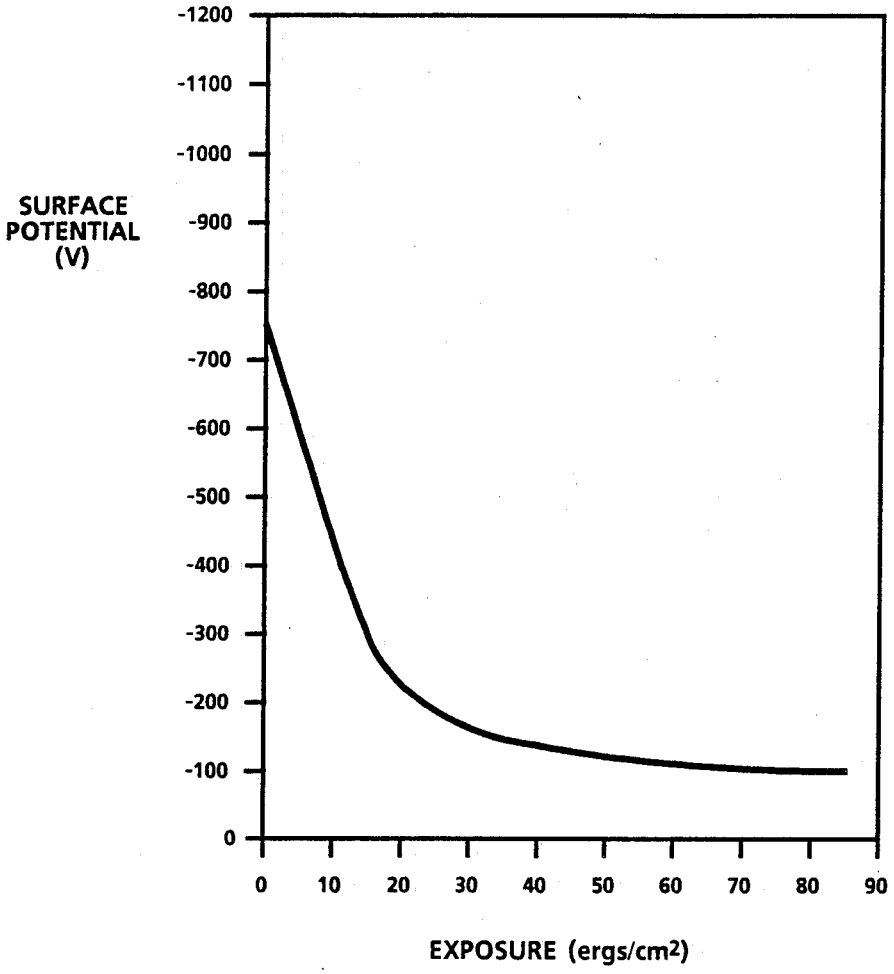
FIG. 6 is a photosensitivity curve for specific imaging members of the present invention.

FIG. 6 illustrates the photosensitivity curve for the imaging member of Example II wherein the surface potential thereof is plotted against the light exposure energies recited.

Other photoconductive imaging members not specifically illustrated in FIGS. 1 or 2 are encompassed within the scope of the present invention.

With further reference to the imaging members of the present invention, the substrates may comprise a layer of insulating material such as an inorganic or organic polymeric material, including Mylar a commercially available polymer; a layer of an organic or inorganic material having a semiconductive surface layer such as indium tin oxide or aluminum arranged thereon, or a conductive material such as, for example, aluminum, chromium, nickel, titanium, brass, or the like. The substrate may be flexible or rigid, and many have a number of many different configurations, such as for example a plate, a cylindrical drum, a scroll, an endless flexible belt, and the like. Preferably, the substrate is in the form of an endless flexible belt. In some situations, it may be desirable to coat on the back of the substrate, particularly when the substrate is an organic polymeric material, an anticurl layer, such as for example, polycarbonate materials commercially available as Makrolon. The thickness of the substrate layer depends on many factors, including economical considerations, thus this layer may be of substantial thickness, for example over 100 mils, or of minimum thickness providing there are no adverse effects on the system. In one preferred embodiment, the thickness of this layer is from about 3 mils to about 10 mils.

The adhesive layers are typically comprised of a polymeric material including polyesters, poly(vinyl butyral), poly(vinyl pyrrolidone), and the like. Typically, this layer is of a thickness of less than about 0.1 micron. The imaging member of the present invention can include other layers therein as illustrated hereinbefore including metal oxide layers such as aluminum oxide and organo silanes, reference U.S. Pat. No. 4,450,450, the disclosure of which is totally incorporated herein by reference. Generally, the thickness of these layers is from about 0.5 to about 1 micron, however, other thickness can be selected providing the objectives of the present invention are achieved.

The photogenerating layers are generally of a thickness of from about 0.05 micron to about 10 microns, or more; and preferably are of a thickness of from about 0.1 micron to about 3 microns; however, the thickness of this layer is primarily dependent on the photogenerator weight loading, which may vary from about 5 to 100 percent. Generally, it is desirable to provide this layer in a thickness which is sufficient to absorb about 90 percent or more of the incident radiation which is directed upon it in the imagewise or printing exposure step. The maximum thickness of this layer is dependent primarily upon factors such as mechanical considerations, for example, whether a flexible photoconductive imaging member is desired, the thicknesses of the other layers, and the specific quinacridone compound selected.

Various suitable aryl amine charge transport layers can be selected for the photoconductive imaging member of the present invention, which layer has a thickness of from about 5 microns to about 50 microns; and preferably is of a thickness of from about 10 microns to about 40 microns. In a preferred embodiment, this transport layer comprises aryl amine molecules of the following formula

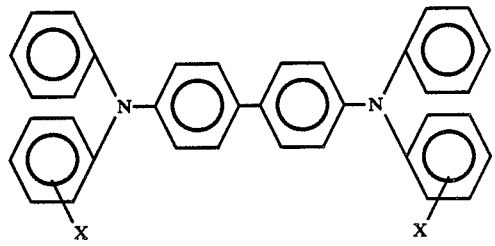

dispersed in a highly insulating and transparent organic resinous binder wherein X is selected from the group consisting of (ortho) $CH_3$, (meta) $CH_3$, (para) $CH_3$, (ortho) Cl, (meta) Cl, or (para) Cl.

Compounds corresponding to the above formula include, for example, N,N'-diphenyl-N,N'-bis(alkylphenyl)-[1,1-biphenyl]-4,4'-diamine wherein the alkyl is selected from the group consisting of methyl such as 2-methyl, 3-methyl, and 4-methyl, ethyl, propyl, butyl, hexyl, and the like. With halo substitution, the amine is N,N'-diphenyl-N,N'-bis(halo phenyl)-[1,1'-biphenyl]-4,4'-diamine wherein halo is 2-chloro, 3-chloro or 4-chloro. Also, as hole transport layers there may be selected the polysilylenes of U.S. Pat. No. 4,618,551, the disclosure of which is totally incorporated herein by reference.

Examples of the highly insulating and transparent resinous material or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyester, polysiloxanes, polyamides, polyurethanes, and epoxies as well as block, random, or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also included within the scope of the present invention are methods of imaging with the photoresponsive devices illustrated herein. These methods generally involve the formation of an electrostatic latent image on the imaging member, followed by developing the image with known developer compositions, reference for example U.S. Pat. Nos. 3,590,000; 4,469,770; 4,560,635 and 4,298,672, the disclosures of which are totally incorporated herein by reference, subsequently transferring the image to a suitable substrate, and permanently affixing the image thereto.

The invention will now be described in detail with reference to specific preferred embodiments thereof, it being understood that these examples are intended to be illustrative only. The invention is not intended to be limited to the materials, conditions, or process parameters recited herein. Also, all parts and percentages are by weight unless otherwise indicated.

EXAMPLE I

Purification of Hostaperm Red EG trans 5250

Two grams of Hostaperm Red EG trans 5250 obtained from BASF were placed at about 5 inches from one end, inside a pyrex tube (outer diameter 1 inch, length 28 inches). The tube was then placed inside a furnace comprised of a thick wall (0.5 inch thickness) copper tube wrapped with two electrical heater bands at one end and water cooling coils at the other end. A temperature gradient of from 500° to 25° was achieved along the length of the tube which was monitored by thermocouple probes. The pyrex tube was positioned such that the quinacridone to be sublimed was located within the heater bands. Thereafter, the quinacridone was heated to about 500° C., and the vapors produced were swept toward the lower temperature end by a flow of low pressure (2 mbar) nitrogen carrier gas. Quinacridone vapor was condensed to form a distinct reddish deposit at a certain location where the temperature was between 440° and 400° C., whereas the more volatile impurities were deposited below 300° C., and thus separated from the purified quinacridone. There remained a small amount of unsublimed residue where the Hostaperm Red EG trans 5250 pigment was originally placed.

The purified Hostaperm Red EG trans 5250 pigment, about 0.1 gram, was obtained in a yield of about 5 percent.

EXAMPLE II

Photoresponsive imaging members were prepared by providing a titanized Mylar substrate in a thickness of 75 microns with a layer of N-methyl-3-aminopropyl triethoxysilane and a DuPont 49,000 polyester adhesive layer thereon in a thickness of 0.05 micron, and depositing thereover with a Balzers vacuum coater a photogenerator layer of the quinacridone of Example I at final thicknesses of 0.4 and 0.5 micron, respectively. A current of 44 amps was used to heat the photogenerator pigment in a tantalum boat, and the vacuum coater evacuated to a pressure of about $10^{-5}$ Torr. Also, the substrate was mounted 16 centimeters from the boat, and the photogenerator layer was deposited at a rate of about 2 to 8 Angstroms/second.

Thereafter, the above photogenerating layers were overcoated with an amine charge transport layer prepared as follows:

A transport layer with 50 percent by weight Makrolon, a polycarbonate resin, was mixed with 50 percent by weight N,N'-diphenyl-N,N'-bis(3-methylphenyl)-1,1'-biphenyl-4,4'-diamine to 13 percent by weight in methylene chloride in an amber bottle. The resulting solution was then coated in a dry thickness of 25 microns on top of each of the above photogenerating layers using a multiple clearance film applicator. The resulting members were then dried in a forced air oven at 135° C. for 20 minutes.

The photosensitivity of the above prepared imaging members were then determined by electrostatically charging the surface thereof with a corona discharge source until the surface potential, as measured by a capacitively coupled probe attached to an electrometer, attained an initial dark value $V_O$ of −810 volts. The front surface of the charged member was then exposed to light from a filtered 150 watt Xenon lamp, allowing light in the wavelength range of 400 to 700 nanometers to reach the member surface. The exposure causing reduction of the surface potential to half of its initial value, $E_{\frac{1}{2}}$, and the percent discharge of surface potential due to various exposure energies was then determined. The photosensitivity can be determined in terms of the exposure in ergs/cm$^2$ necessary to discharge the member from the initial surface potential to half that value. The higher the photosensitivity, the smaller the exposure energy required to discharge the layer to 50 percent of the surface potential. The photosensitivity results are summarized in the following table.

| Thickness of Photogenerating Layer of Hostaperm Red EG trans 5250 | $E_{\frac{1}{2}}$ ergs/cm$^2$ | % Discharge at 10 ergs/cm$^2$ |
|---|---|---|
| 0.4 micron | 30.0 | 20 |
| 0.5 micron | 18.0 | 32 |

The dark decay (loss in surface potential in the dark following charging) is less than 30 volts/second for each member.

The photosensitivity results for the above prepared imaging member, 0.4 micron thickness, are illustrated in FIG. 6 where the surface potential is plotted against various exposure energies, whereas the plot of the same imaging member is illustrated in FIG. 5.

The characteristics of the imaging members of Example II indicate that such a member can be selected for the generation of developed images of excellent quality with substantially no background deposits. These imaging members may be negatively charged, for example, when the photogenerating layer is situated between the hole transport layer and the supporting substrate, or positively charged when the hole transport layer is situated between the photogenerating layer and the substrate. With negatively charged imaging members, there is selected a positively charged developer composition, that is wherein the toner composition is positively charged and contains therein a charge enhancing additive such as distearyl dimethyl ammonium methyl sulfate, reference U.S. Pat. No. 4,560,635, the disclosure of which is totally incorporated herein by reference. When the imaging member is positively charged, there is selected a negatively charged developer composition comprised of resin particles such as styrene n-butyl methacrylate copolymers, and pigment particles such as carbon black, reference for example U.S. Pat. No. 4,469,770, the disclosure of which is totally incorporated herein by reference.

Other modifications of the present invention may occur to those skilled in the art subsequent to a review of the present application, and these modifications are intended to be included within the scope of the present invention.

What is claimed is:

1. An improved photoconductive imaging member comprised of a supporting substrate; a vacuum evaporated photogenerating layer comprised of fractionally sublimed quinacridone compounds of the formulas of FIGS. 1 or 2, wherein X is independently selected from the group consisting of hydrogen, alkyl, alkoxy and hydroxy; and an aryl amine hole transport layer; and wherein the fractional sublimation is accomplished by subjecting the aforementioned quinacridone compounds to a temperature of from about 200° to about 500° C. whereby impurities and decomposition products more volatile than the quinacridones are separated at a temperature zone below 300° C., and there is obtained the desired quinacridone component of a purity of at least about 95 percent at a temperature zone of from about 400° to about 440° C.

2. An imaging member in accordance with claim 1 wherein X is the halogen, chlorine, bromine, iodine or fluorine.

3. An imaging member in accordance with claim 1 wherein the quinacridone is 2,9-dichloroquinacridone.

4. An imaging member in accordance with claim 1 wherein the vacuum deposited photogenerating layer is situated between the supporting substrate and the hole transport layer.

5. An imaging member in accordance with claim 1 wherein the aryl amine hole transport layer is situated between the supporting substrate and the vacuum deposited photogenerating layer.

6. An imaging member in accordance with claim 1 wherein the supporting substrate is comprised of a conductive metallic substance, or an insulating polymeric composition overcoated with an electrically conductive layer.

7. An imaging member in accordance with claim 1 wherein the supporting substrate is aluminum, an organic polymeric composition, or a titanized Mylar.

8. An imaging member in accordance with claim 1 wherein the photogenerating compound is dispersed in a resinous binder in an amount of from about 5 percent by weight to about 95 percent by weight.

9. An imaging member in accordance with claim 8 wherein the resinous binder is a polyester, poly(vinyl butyral), a polycarbonate, poly(vinyl formal), or poly(-vinyl chloride).

10. An imaging member in accordance with claim 1 wherein the aryl diamine compound comprises molecules of the formula

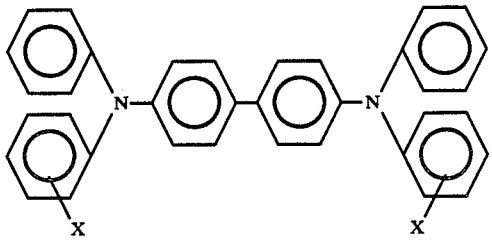

dispersed in a highly insulating and transparent organic resinous binder wherein X is selected from the group consisting of alkyl and halogen.

11. An improved imaging member in accordance with claim 9 wherein X is selected from the group consisting of ortho ($CH_3$), meta ($CH_3$), para ($CH_3$), ortho (Cl), meta (Cl), or para (Cl).

12. An imaging member comprised of (1) a supporting substrate; (2) a silane hole blocking layer; (3) a photogenerating layer comprised of the quinacridone compounds of claim 1; and (4) an aryl amine hole transport layer.

13. An imaging member in accordance with claim 12 wherein there is included between the silane hole blocking layer and the vacuum deposited quinacridone photogenerating layer an adhesive layer.

14. An imaging member in accordance with claim 13 wherein the adhesive layer is a polyester resin.

15. An imaging member in accordance with claim 12 wherein the aryl amine comprises molecules of the formula

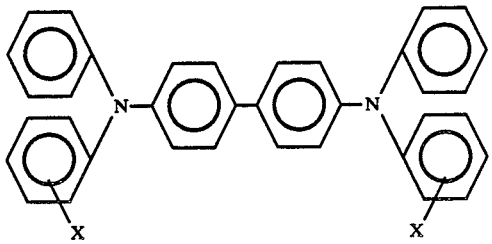

wherein X is selected from the group consisting of alkyl and halogen.

16. A method of imaging which comprises generating an electrostatic image on the imaging member of claim 1; developing the image; subsequently transferring this image to a suitable substrate; and thereafter permanently affixing the image thereto.

17. A method of imaging which comprises generating an electrostatic image on the imaging member of claim 12, developing the image; subsequently transferring this image to a suitable substrate; and thereafter permanently affixing the image thereto.

18. A method of imaging in accordance with claim 16 wherein the photogenerating layer selected for the imaging member is 2,9-dichloroquinacridone.

19. A method of imaging in accordance with claim 17 wherein the photogenerating layer selected for the imaging member is 2,9-dichloroquinacridone.

20. A photoconductive imaging member comprised of a vacuum evaporated photogenerating layer comprised of fractionally sublimed quinacridone compounds of the formulas of FIGS. 1 or 2, wherein X is independently selected from the group consisting of hydrogen, halogen, alkyl, alkoxy, and hydrox;, and an aryl amine hole transport layer; and wherein the fractional sublimation is accomplished by subjecting the aforementioned quinacridone compounds to a temperature of from about 200° to about 500° C. whereby impurities and decomposition products more volatile than the quinacridones are separated at a temperature zone below 300° C., and there is obtained the desired purified quinacridone component at a temperature zone of from about 400° to about 440° C.

21. An imaging member in accordance with claim 20 wherein the aryl amine comprises molecules of the formula

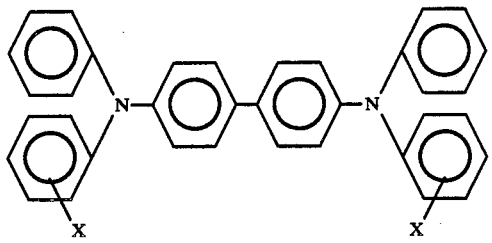

wherein X is selected from the group consisting of alkyl and halogen.

22. An imaging member in accordance with claim 1 wherein the fractionally sublimed quinacridone compounds are prepared by heating said compounds to a temperature of from about 200° to about 500° C. whereby impurities in decomposition products more volatile than the desired components are separated at a temperature zone of below 300° C.

23. An imaging member in accordance with claim 22 wherein the resulting purified quinacridone compounds of a purity of at least 95 percent are obtained at a temperature zone of from about 400° to about 440° C.

24. An imaging member in accordance with claim 1 with a photosensitivity of from about 400 to about 700 nanometers.

25. An imaging member in accordance with claim 22 with a photosensitivity of from about 400 to about 700 nanometers.

26. An imaging member in accordance with claim 23 with a photosensitivity of from about 400 to about 700 nanometers.

27. An imaging member in accordance with claim 1 wherein the purified quinacridone components are separated from nonvolatile impurities, which nonvolatile impurities remain at a high temperature zone.

28. An imaging member in accordance with claim 27 wherein the high temperature zone is about 500° C.

29. A process for the preparation of a photoconductive imaging member which comprises providing a supporting substrate; applying thereto by vacuum evaporation a photogenerating quinacridone layer subsequent to the fractional sublimation thereof, which quinacridone components are of the formula of FIGS. 1 or 2, wherein X is independently selected from the group consisting of hydrogen, halogen, alkyl, alkoxy and hydroxy; and an aryl amine hole transport layer; and wherein the fractional sublimation is accomplished by subjecting the aforementioned quinacridone compounds to a temperature of from about 200° to about 500° C. whereby impurities and decomposition products more volatile than the quinacridones are separated at a temperature zone below 300° C., and there is obtained the desired quinacridone component of a purity of at least about 95 percent at a temperature zone of from about 400° to about 440° C.

* * * * *